United States Patent [19]

McCoy et al.

[11] Patent Number: 4,714,049

[45] Date of Patent: Dec. 22, 1987

[54] APPARATUS TO REDUCE OR ELIMINATE FLUID BED TUBE EROSION

[75] Inventors: Daniel E. McCoy; Donald L. Garver; George Hileman, all of Williamsport, Pa.

[73] Assignee: Dorr-Oliver Incorporated, Stamford, Conn.

[21] Appl. No.: 916,689

[22] Filed: Oct. 8, 1986

[51] Int. Cl.[4] ..... F22B 1/00

[52] U.S. Cl. ..... 122/4 D; 122/367 C; 122/DIG. 13; 165/104.16; 165/134.1; 165/179

[58] Field of Search ..... 122/367 C, 4 D, DIG. 13; 165/104.16, 134.1, 179

[56] References Cited

U.S. PATENT DOCUMENTS

| | | | |
|---|---|---|---|
| 4,124,068 | 11/1978 | Thompson | 122/4 D X |
| 4,249,594 | 2/1981 | Elkins et al. | 165/104.16 |
| 4,396,056 | 8/1983 | Hodges et al. | 122/4 D X |
| 4,442,799 | 4/1984 | Craig et al. | 122/367 C |
| 4,554,967 | 11/1985 | Johnson et al. | 122/4 D X |

*Primary Examiner*—Edward G. Favors

*Attorney, Agent, or Firm*—P. D. Greeley; H. M. Snyder

[57] ABSTRACT

Apparatus to reduce or eliminate fluid bed erosion in fluidized bed combustion boilers by increasing the fireside tube temperature by adding appropriately dimensioned longitudinal or circumferential fins to the inbed heat exchange tubes in the reactor.

13 Claims, 10 Drawing Figures

FIG. 1a
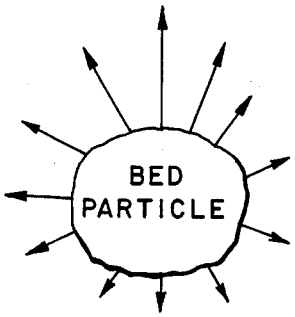
TYPICAL MEAN
PARTICLE VELOCITIES
FIG. 1b
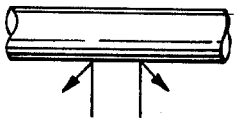
ANGLE OF INCIDENCE
-HORIZONTAL TUBE-
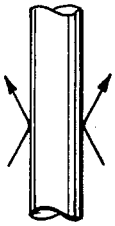
FIG. 1c
ANGLE OF INCIDENCE
-VERTICAL TUBE-
"GLANCING BLOW"
FIG. 2a
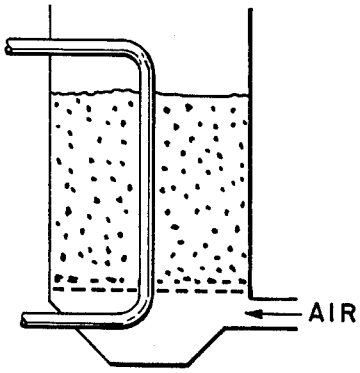
SUPERFICIAL VELOCITY
4-6 FT./SEC.
FIG. 2b
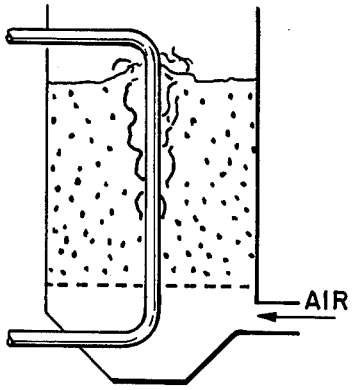
SUPERFICIAL VELOCITY
6-8 FT./SEC.

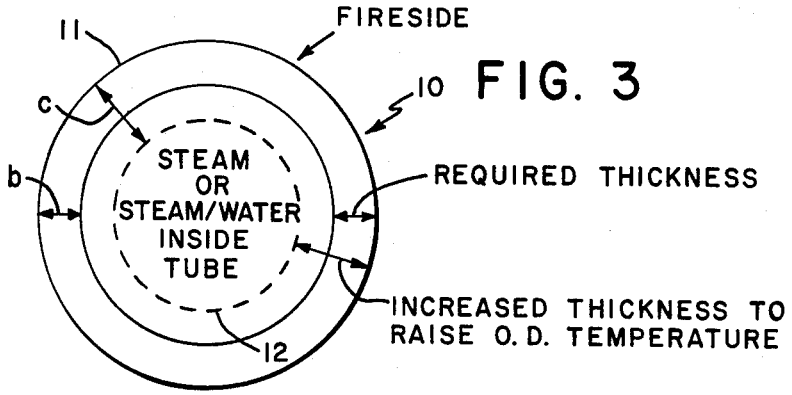
FIG. 3
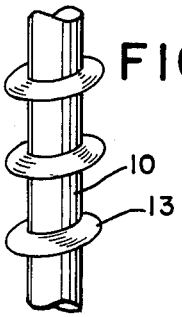
FIG. 4A
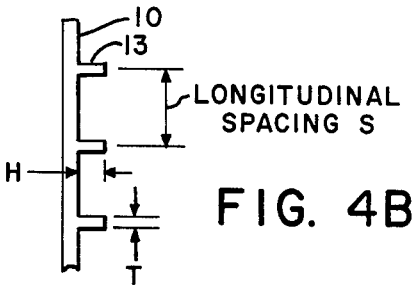
FIG. 4B
FIG. 5
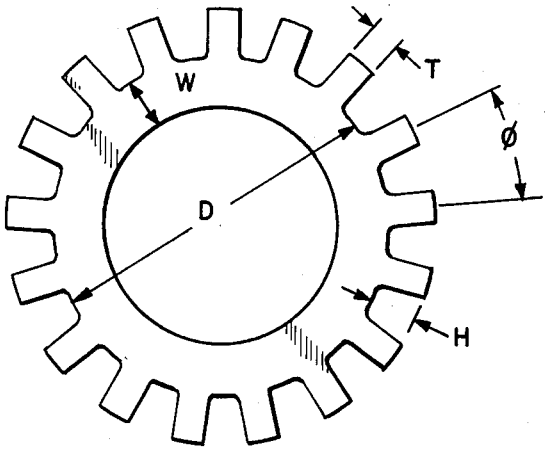
FIG. 6
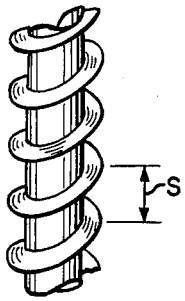

APPARATUS TO REDUCE OR ELIMINATE FLUID BED TUBE EROSION

BACKGROUND OF THE INVENTION

The present invention relates to fluid bed combustion boiler technology generally of the type disclosed in U.S. Pat. No. 4,449,482, and, more particularly, to apparatus for reducing or eliminating the erosion of inbed heating surfaces in both bubbling and newer circulating conventional fluid beds.

Beginning in the early 1970's, serious investigations were undertaken with respect to fluidization as a combustion technique because it permitted the use of low grade and high sulfur fuels in an environmentally acceptable manner. The utilization of fluid bed combustion has proceeded rapidly since that time because, among other things, safe and economical sludge disposal has become a serious challenge to communities with little acreage or tolerance for sludge drying beds and because land application is hazardous because of potential groundwater and soil contamination. Fluid bed combustion has found acceptance in other applications, such as wastewater treatment plants, inasmuch as this technique provide an ideal environment for the thermal oxidation of most biological wastes.

The fluidization technique involves the suspension of solids by an upward gas stream so as to resemble a bubbling fluid. The suspension is typically contained in the lower-middle portion of a cylindrical carbon steel reactor and is bound laterally by the reactor walls and below by a gas distribution grid or constriction plate beneath which is a windbox. In U.S. Pat. No. 4,449,482, the gas distribution grid takes the form of an array of sparge pipes supplied with air by an air header.

Despite the rapid development of fluid bed combustion technology, the problem of erosion of the inbed heat transfer surface in the form of tubes or the like remains. Although erosion problems have to date been primarily encountered on older and more numerous bubbling bed units, it is expected that the newer circulating fluid bed units will encounter similar problems in the lower or dense bed and to some degree in the lean phase above the dense bed.

Experience shows that vertical inbed heat exchange tubes of the type shown in U.S. Pat. No. 4,449,482, experience much lower erosion rates than horizontal tubes. Erosion rate is, of course, a function of many variables such as the hardness of the bed particles, the velocity of the particles when they strike the tubes, and the angle of incidence at which the particles strike the tubes. One reason for high wear rates on the bottom of horizontal tubes is believed to be the more direct impingement of the particles on the tubes and high upward mean velocities of those particles.

Although each particle in the fluid bed has random movement, there is an additive vertical velocity resulting from the fluidizing air entering at the bottom of the bed through a constriction plate and the products of combustion leaving at the top. This additive vertical velocity vector is quite high because the actual velocity of the air and gas is very large as they make their way up through and between the fluidized bed particles.

FIGS. 1(*a*) through 1(*c*) illustrate the foregoing. FIG. 1(*a*) shows typical mean particle velocities with the generally upward vertical velocity vectors being much greater than the generally downward vertical and the horizontal vectors. FIG. 1(*b*) shows the angle of incidence of the particles on a horizontal tube. From the illustration, it can be seen that the horizontal tube bottom is hit by particles at a greater angle of incidence, i.e. a direct blow, and with the highest magnitude vertical velocity vectors. FIG. 1(*c*) shows the decreased angle of incidence, i.e. a glancing blow, which vertical tubes experience and which may account, at least to some degree, for the longer life of vertical tubes.

Nevertheless, experience to date has resulted in unsatisfactory erosion rates also with vertical tubes. This suggested to us that there might be other variables in addition to the inbed tube orientation. We considered and investigated factors such as particle hardness but found that serious erosion was related to what is known as "superficial velocity" or the velocity of the air and/or gas. Older units have superficial velocities in the 4 to 6 feet per second range, whereas new units have superficial velocities in the 6 to 8 feet per second range.

At superficial velocities of 4 to 6 feet per second range, vertical inbed tubes appear to alleviate the erosion problem. However, at higher velocities they seem to provide little or no help in reducing erosion. We believe that the explanation for this may reside in the "bubble coalescing theory" which is illustrated in FIGS. 2(*a*) and 2(*b*) with the vertical inbed tubes. In FIG. 2(*a*) there is shown a bed having superficial velocities of 4 to 6 feet per second. The vertical tubes do not tend to collect the small bubbles that occur naturally in a fluid bed. FIG. 2(*b*) shows that the vertical tubes in a fluid bed with superficial velocities of 6 to 8 feet per second tend to collect or coalesce the naturally occurring small bubbles which grow and rise rapidly. This causes a backflow of particulate matter at the tube which, in turn, causes erosion.

Whatever the explanation, vertical inbed tubes experience severe erosion at higher superficial velocities typically found in high circulating fluid bed boilers. Even at lower velocities, horizontal tubes experience severe erosion because of the higher angle of incidence (direct particle impingement) and the higher upward mean particle velocity.

We have further discovered an unusual phenomenon in units which have both vertical superheater tubes and saturated inbed tubes. Shortly after startup of such a unit, the saturated inbed tubes experience severe erosion while the superheater tubes which were just a few inches away showed no erosion. We first attributed this difference to the fact that the superheater tubes were stainless steel whereas the saturated tubes were plain carbon steel. However, we eliminated this possibility by using superheater and saturated tubes made of the same material when the saturated tubes eroded and the superheater tubes did not erode substantially.

We readily appreciated, of course, that the fire-side or combustion side cannot differentiate between a tube which contains a steam-water or saturated mixture and a tube that contains superheater steam, but we also recognized that the outside diameter metal temperature for the superheater tube is several hundred degrees higher than for the saturated tube. Consequently, we concluded that an explanation for the difference seems to be that the superheater tube fireside metal temperature is higher than that of the saturated tube. In fact, as if to suggest the influence of temperature, we noted that each time a unit was taken out of service, a glazed or solidified coating on the superheater tubes could be observed, whereas the surface of the saturated tubes was bright metal and had no protective coating. Thus, our invention proceeds upon the discovery that superheater tubes operate at a sufficiently high temperature that they are coated with a thin film of liquid or sticky material from the bed which protects the tubes from the abrasive fluidized bed particles.

With regard to the coating material, we believe this may occur as a result of a vaporized constituent in the bed that condenses on the superheater tube. On one hand, the superheater tube temperature is high enough to keep the condensed film in a liquid or semi-solidified, or sticky, state; on the other hand, with the saturated tube the fireside temperature is low enough that the gaseous constituents condense and solidify, and the solidified particles do not stick to the tube to protect it. They are thus easily brushed off the tube by the fluid bed action and do not provide any protection from erosion. The coating which protects the superheater tubes may also be liquid droplets that adhere to the surface of the fluid bed particles. Inasmuch as the superheater tubes operate at a sufficiently high temperature, the coating on the tubes would be either in the liquid or sticky phase. We have also noted that the refractory material, metal lugs and brackets on a unit that operate at high fire side temperatures show such a liquid or sticky phase-type protection.

As the foregoing theories developed, several alternative were utilized to protect vertical tubes. One such method was the use of a flame spray coating tube to coat the tube. However, these hard coatings have not proven to be a satisfactory solution. Another way is shown in FIG. 3 wherein the wall thickness of the inbed heating surface in the form of a tube is increased. The tube designated generally by the numeral 10 has an outer surface and the portion of that outer surface which is exposed to the combustion or fire side temperature is designated by the numeral 11. For example, a 3 inch O.D. tube can be used. The letter b designates the required thickness normally used for such a heating surface. In the case of a 3 inch tube, that thickness can be 0.20 inch. However, by increasing the thickness to that shown by the letter c so that the inside diameter is smaller as designated by the numeral 12 (in the case of the 3 inch tube, the thickness can be increased to 0.40 inch), the outside diameter temperature can be raised slightly to aid in the formation of the liquid or semi-liquid coating, but there will be some reduction to the overall heat transfer rate.

SUMMARY OF THE INVENTION

It is an object of our invention to reduce or completely eliminate the erosion of inbed heat transfer surfaces such as tubes in a simple yet effective manner. We have discovered that one way of accomplishing this object is to increase the fire side tube metal temperature to at least about 700° F. by adding external surface area while keeping the inside surface area constant.

One presently preferred embodiment for achieving the foregoing object is obtained by adding external longitudinal fins on the tubes. Another embodiment utilizes circumferential fins although this has more of an overall effect on heat transfer. Although circumferential fins can be used within the scope of the present invention, the overall heat transfer rate will be reduced, whereas with longitudinal fins the full tube and fin surface will be exposed to the active fluid bed.

The present invention resides in the recognition that, as more external fins are added to the tube and, in particular, isothermal lines move further from the fin, the protected areas on the tubes increase.

Our discovery thus provides inbed tube erosion protection by means of a liquid phase or partially solidified (sticky) coating which protects a heating surface (usually the inbed tubes) from erosion by having the combustion side temperature of the heating surface sufficiently high.

BRIEF DESCRIPTION OF THE DRAWINGS

These and further features, objects and advantages of the present invention will become more apparent from the following description of several preferred embodiments of our invention when taken in conjunction with the accompanying drawing which shows, for illustrative purposes only, the several presently preferred embodiments of our invention and wherein:

FIG. 1(*a*) shows typical mean particle velocities.

FIG. 1(*b*) shows the angle of incidence of the particles on a horizontal tube.

FIG. 1(*c*) shows the decreased angle of incidence on a vertical tube.

FIGS. 2(*a*) and 2(*b*) illustrates the "bubble coalescing theory."

FIG. 3 is a cross-sectional view of an inbed tube showing an embodiment which utilizes an increased tube wall thickness to raise the outside diameter temperature of the tube;

FIG. 4A is a perspective view of an embodiment of our invention showing the use of circumferential tubes;

FIG. 4B is a plan view of a wall of the tube shown in FIG. 4A to show the relationship of the fin diameter to the tube diameter and also the fin spacing;

FIG. 5 is a cross-sectional view of an inbed tube utilizing longitudinal fins in accordance with another embodiment of our invention; and FIG. 6 is a perspective view of another embodiment of our invention showing the use of circumferential fins produced by a continuous spiral winding on the tube.

DETAILED DESCRIPTION OF SEVERAL PRESENTLY PREFERRED EMBODIMENTS

In practicing our invention, it must be remembered that whatever changes are made to tube geometry, the changes should not be detrimental to the basic purpose of the inbed heating surface, i.e. heat transfer. However, to carry out our invention, the tube must be designed so that the fluid bed or combustion side of the tubes will operate at a sufficiently high temperature to permit the liquid or semi-liquid coating to be retained, though not completely solidified, and replenished continuously during operation.

FIG. 4A shows one way in accordance with our present invention of increasing the fire side temperature by the use of circumferential fins 13 on the tube 10. These circumferential fins can also be continuously spirally wound in the tube in a continuous manner as shown in FIG. 6. As shown in FIG. 4B, a longitudinal spacing s is maintained between the fins but it must be sufficiently small to maintain a stagnant layer of inactive bed material adjacent to the tube. However, the overall effect of the use of circumferential fins, at least in vertical bed tubes, may be to reduce heat transfer. We contemplate use of tubes of SA 178 and SA 106 carbon steel having a range of diameters (D) from 1 inch to 6 inches. We have also used fins constructed from A36 carbon steel, Type 304H stainless steel, or Type 316H stainless steel. The spacing (s) and the fin height (H) (FIG. 4B)

are ≈D/3. The fin thickness (T) is between about 0.125 inch and 0.50 inch. We estimate a reduction in heat transfer of between about 20% to 50% with this arrangement.

Circumferential fins of the above-described type may be more acceptable for horizontal or nearly horizontal inbed tubes where the net heat transfer may actually be increased because of the additional effective surface provided by the fins. Again using fins and tubes of the above-mentioned materials and tube diameters (D) ranging from 1 inch to 6 inches, a fin spacing (s) of between about 0.25 inch to 2.0 inches, a fin thickness (T) of between about 0.125 inch and 0.50 inch, and a fin height (H) of ≈D/3 will bring an estimated 10% to 40% increase in heat transfer.

With vertical or nearly vertical inbed tubes, longitudinal fins of the type shown in FIG. 5 not only sufficiently raise the fire side temperature to provide liquid phase protection but also increase the effective heat transfer surface to enhance overall heat transfer. Again, the tube diameter can be in the range of 1 inch to 6 inches. The tube wall thickness (W) must satisfy boiler design pressure but typically is in the range between 0.095 inch to 0.50 inch. Fin thickness (T) ranges from about 0.125 inch to 0.50 inch. Fin spacing ($\phi$) ranges between about 20° to 60°, and fin height (H) is ≈D/3. In one particular installation which used SA 178 carbon steel tubes having a 3.0 inch diameter (D) and a wall thickness (W) of 0.120 inch and A36 carbon steel fins with a full penetration weld between the fins and tubes, we obtained optimum results with a fin spacing ($\phi$) of 30°, a fin thickness (T) of 0.25 inch, and a fin height (H) of 0.75 inch.

While we have shown and described several embodiments in accordance with our invention, it is to be clearly understood that the same are susceptible to numerous changes and modifications apparent to one skilled in the art. For example, as previously pointed out, the circumferential fins can consist of individual circles or a continuous spiral wound on the tube. Neither the circumferential fins nor the longitudinal fins need consist of continuous ribbons of material; instead they can be fabricated from individual studs of varying shape placed on the tubes to form a continuous circumferential or longitudinal pattern. Therefore, we do wish to be limited to the details shown and described but intend to cover all such changes and modifications which come within the scope of the appended claims.

We claim:

1. A fluidized bed boiler or reactor, comprising a housing, a reaction chamber within said housing, air distribution means within said reaction chamber, a plurality of heat exchange tubes approximately horizontally disposed and arranged with a fluidized bed region within the chamber, wherein the improvement comprises:

fin means being associated with said heat exchange tubes, said fin means comprise a plurality of individual fins circumferentially arranged around said heat exchange tubes and spaced from each other along the axis of said heat exchange tubes by a distance of between 0.25–2.00 inches and said heat exchange tubes having an outer diameter in the range between 1–6 inches, whereby the fire-side temperature of said heat exchange tubes is increased so as to result in the coating of said heat exchange tubes with a thin film of material from said fluidized bed region which protects said heat exchange tubes from erosion.

2. A fluidized bed boiler or reactor, comprising a housing, a reaction chamber within said housing, air distribution means within said reaction chamber, a plurality of heat exchange tubes approximately vertically disposed and operately arranged with a fluidized bed region within the chamber, wherein the improvement comprises:

fin means being associated with said heat exchange tubes, said fin means comprise a plurality of individual fins circumferentially arranged around said heat exchange tubes and spaced from each other along the axis of said heat exchange tubes by a distance equal to approximately one-third of the outer diameter of said heat exchange tubes, said outer diameter being in the range of 1–6 inches, whereby the fire-side temperature of said heat exchange tubes is increased so as to result in the coating of said heat exchange tubes with a thin film of material from said fluidize bed regions which protects said heat exchange tubes from erosion.

3. A fluidized bed boiler or reactor according to claim 2 wherein said fins have a height as measured from root to tip equal to approximately one-third of the tube outer diameter.

4. A fluidized bed boiler or reactor according to claim 3, wherein said fins have a thickness of between about 0.125–0.50 inches.

5. A fluidized bed boiler or reactor according to claim 1, wherein said fins have a height as measured from root to tip equal to approximately one-third of the tube outer diameter.

6. A fluidized bed boiler or reactor according to claim 5, wherein said fins have a thickness of between about 0.125 inch and 0.50 inch.

7. A fluidized bed boiler or reactor, comprising a housing, a reaction chamber within said housing, air distribution means within said reaction chamber, a plurality of heat exchange tubes operately arranged with a fluidized bed region within the chamber, wherein the improvement comprises:

fin means being associated with said heat exchange tubes, said fin means comprises a plurality of individual fins longitudinally arranged along said heat exchange tubes and spaced from each other circumferentially around said heat exchange tubes in a range of between about 20° to 60°, said fins have a height from root to tip equal to approximately one-third of the tube outer diameter, whereby the fire-side temperature of said heat exchange tubes is increased so as to result in the coating of said heat exchange tubes with a thin film of material from said fluidized bed region which protects said heat exchange tubes from erosion.

8. A fluidized bed boiler or reactor, comprising a housing, a reaction chamber within said housing, air distribution means within said reaction chamber, a plurality of heat exchange tubes operately arranged with a fluidized bed region within the chamber, wherein the improvement comprises:

fin means being associated with said heat exchange tubes, said fin means comprises a plurality of individual fins longitudinally arranged along said heat exchange tubes and spaced from each other circumferentially around said heat exchange tubes in a range of between about 20° to 60°, said fins have a height from root to tip equal to approximately one-third of the tube outer diameter, said tubes have an outer diameter in the range of between 1 inch and 6 inches, and said fins have a thickness in the range of between about 0.125 inch and 0.50 inch, whereby the fire-side temperature of said heat exchange tubes is increased so as to result in the coating of said heat exchange tubes with a thin film of material from said fluidized bed region which protects said heat exchange tubes from erosion.

9. A fluidized bed boiler or reactor, comprising a housing, a reaction chamber within said housing, air distribution means within said reaction chamber, a plurality of heat exchange tubes operately arranged with a fluidized bed region within the chamber, wherein the improvement comprises:

fin means being associated with said heat exchange tubes, said fin means is spirally wound along the axial length of said heat exchange tubes such that the pitch of the spirally wound fin means is equal to approximately one-third of the outer diameter of said heat exchange tubes and wherein said heat exchange tubes have an outer diameter in the range between 1–6 inches, whereby the fire-side temperature of said heat exchange tubes is increased so as to result in the coating of said heat exchange tubes with a thin film of material from said fluidized bed region which protects said heat exchange tubes from erosion.

10. A fluidized bed boiler or reactor according to claim 9, wherein said fins have a height as measured from root to tip equal to approximately one-third of the outer diameter of said heat exchange tubes.

11. A fluidized bed boiler or reactor according to claim 9, wherein said tubes are approximately vertically disposed within said chamber.

12. A fluidized bed boiler or reactor according to claim 9, wherein said tubes are approximately horizontally disposed within said chamber.

13. A fluidized bed boiler or reactor according to claim 9, wherein said fins have a thickness of between about 0.125 inch and 0.50 inch.

* * * * *